US009243405B2

(12) United States Patent
St-Laurent et al.

(10) Patent No.: US 9,243,405 B2
(45) Date of Patent: Jan. 26, 2016

(54) TRACKLESS SUSPENDED CEILING

(75) Inventors: André St-Laurent, Laval (CA); Vincent Gendreau, Montréal (CA)

(73) Assignee: LES PLAFONDS EMBASSY INC., Warwick QC (CA)

( * ) Notice: Subject to any disclaimer, the term of this patent is extended or adjusted under 35 U.S.C. 154(b) by 0 days.

(21) Appl. No.: 14/126,826

(22) PCT Filed: Jun. 18, 2012

(86) PCT No.: PCT/CA2012/000597

§ 371 (c)(1),
(2), (4) Date: Dec. 16, 2013

(87) PCT Pub. No.: WO2012/171115

PCT Pub. Date: Dec. 20, 2012

(65) Prior Publication Data

US 2014/0109505 A1 Apr. 24, 2014

Related U.S. Application Data

(60) Provisional application No. 61/497,557, filed on Jun. 16, 2011.

(51) Int. Cl.

| | |
|---|---|
| ***E04B 9/00*** | (2006.01) |
| ***E04B 9/24*** | (2006.01) |
| ***E04B 9/10*** | (2006.01) |
| ***E04B 9/04*** | (2006.01) |
| ***E04B 9/22*** | (2006.01) |
| ***E04B 9/26*** | (2006.01) |

(52) U.S. Cl.

CPC ..... *E04B 9/241* (2013.01); *E04B 9/0435* (2013.01); *E04B 9/0464* (2013.01); *E04B 9/10* (2013.01); *E04B 9/225* (2013.01); *E04B 9/26* (2013.01); *E04B 9/003* (2013.01)

(58) Field of Classification Search

CPC ..... E04B 9/241; E04B 9/0435; E04B 9/225; E04B 9/0464; E04B 9/10

USPC ..... 52/506.06, 506.08, 506.09, 506.1, 541, 52/591.4, 592.2

See application file for complete search history.

(56) References Cited

U.S. PATENT DOCUMENTS

| | | | | | |
|---|---|---|---|---|---|
| 2,059,483 | A | * | 11/1936 | Parsons | 52/506.06 |
| 2,065,796 | A | * | 12/1936 | Davis | 52/506.1 |
| 2,083,104 | A | * | 6/1937 | Thomas et al. | 52/506.1 |
| 2,143,980 | A | * | 1/1939 | Guastavino | 52/506.09 |

(Continued)

FOREIGN PATENT DOCUMENTS

| | | | |
|---|---|---|---|
| CH | GB 810740 | * | 3/1959 |

*Primary Examiner* — Adriana Figueroa

(74) *Attorney, Agent, or Firm* — Equinox IP; Franz Bonsang

(57) ABSTRACT

A suspended ceiling comprises first and second rows of panels being connected to overhead structures and an intermediate row of panels interposed therebetween. Each panel comprises front and rear edges and lateral sides. The first lateral side of a given panel of the intermediate row is configured to be releasably mounted to the complementarily configured lateral side of an adjacent panel of the first row. The second lateral side of the given panel of the intermediate row is configured to be releasably mounted to the complementarily configured lateral side of an adjacent panel of the second row. The given panel of the intermediate row can be removed by being lifted away from the panels of the first and second rows.

3 Claims, 12 Drawing Sheets

(56) References Cited

U.S. PATENT DOCUMENTS

| | | | | | |
|---|---|---|---|---|---|
| 3,077,426 | A * | 2/1963 | Johnston | 181/286 |
| 3,263,388 | A * | 8/1966 | Bogert | 52/665 |
| 3,456,411 | A * | 7/1969 | Cacossa | 52/506.1 |
| 3,581,453 | A * | 6/1971 | Jones et al. | 52/506.1 |
| 3,817,014 | A * | 6/1974 | Jones | 52/478 |
| 5,687,526 | A * | 11/1997 | Benvenuto et al. | 52/506.08 |
| 5,893,250 | A * | 4/1999 | Benvenuto et al. | 52/506.08 |
| 6,763,641 | B1 * | 7/2004 | Ahren et al. | 52/506.06 |
| 7,810,297 | B2 * | 10/2010 | Moriau et al. | 52/591.1 |
| 8,171,692 | B2 * | 5/2012 | Pervan | 52/592.2 |
| 2005/0108970 | A1 * | 5/2005 | Liu | 52/581 |
| 2007/0079562 | A1 * | 4/2007 | Buck et al. | 52/63 |
| 2008/0276560 | A1 * | 11/2008 | Labonte | 52/506.06 |
| 2010/0257808 | A1 * | 10/2010 | Baxter et al. | 52/586.1 |

* cited by examiner

TRACKLESS SUSPENDED CEILING

CROSS-REFERENCE TO RELATED APPLICATIONS

The present application claims priority on U.S. Provisional Patent Application No. 61/497,557 filed on Jun. 16, 2012 which is incorporated by reference herein in its entirety.

TECHNICAL FIELD

The present disclosure generally relates to ceilings. More particularly but not exclusively, the present disclosure relates to suspended ceilings. Still more particularly but still not exclusively, the present disclosure relates to a kit of parts adapted to be assembled to form a ceiling.

BACKGROUND

Suspended ceilings are usually made of a metal grid consisting of tracks in the form of longitudinal parallel runners spaced apart from one another at a desired distance and separated by cross members in a perpendicular fashion thereby creating a plurality of rectangular openings. In general, those rectangular openings are of standard sizes allowing the ventilation outlets and the lighting fixtures to be easily inserted among the ceiling panels.

Suspended ceilings have been mostly utilized in office buildings and in housing basements because of the handiness that such systems allow to repair and/or to modify the partition of the space. However, most development in suspended ceilings has been towards improving the convenience for offices, without any improvement to the visual aspect of the ceiling. Indeed, the typical ceiling panels are made of fibrous material with a flat bottom finish, which are inserted in the rectangular openings made of the metal grid. Such unappealing designs have restricted the installation of suspended ceilings in residential construction to the basement and hinder their distribution whenever an upscale finish is desired.

The use of tracks also increases labor and material costs and interferes with the overall esthetic look of the suspended ceiling.

OBJECTS

It is an object of the present disclosure to provide a suspended ceiling.

It is an object of the present disclosure to provide a trackless suspended ceiling.

It is an object of the present disclosure to provide a ceiling panel for a trackless suspended ceiling.

It is an object of the present disclosure to provide a kit for a trackless suspended ceiling.

SUMMARY

In accordance with an aspect of the disclosure, there is provided a suspended ceiling comprising: a first row of panels being connected to overhead structures, each panel of the first row comprising front and rear edges and lateral sides; a second row of panels being connected to overhead structures, each panel of the second row comprising front and rear edges and lateral sides thereof; and an intermediate row of panels interposed between the first and second row, each panel of the intermediate row comprising front and rear edges and lateral sides thereof, the first lateral side of a given panel of the intermediate row being configured to be releasably mounted to the complementarily configured lateral side of an adjacent panel of the first row, the second lateral side of the given panel of the intermediate row being configured to be releasably mounted to the complementarily configured lateral side of an adjacent panel of the second row, wherein the given panel of the intermediate row can be removed by being lifted away from the panels of the first and second rows.

In an embodiment, the first lateral side of each panel of the intermediate row is configured to be releasably mounted to the complementarily configured lateral side of an adjacent panel of the first row, the second lateral side of each panel of the intermediate row being configured to be releasably mounted to the complementarily configured lateral side of an adjacent panel of second row, wherein each panel of the intermediate row can be removed by being lifted away from the panels of the first and second rows. In an embodiment, the first lateral side of each panel of the intermediate row comprises a protruding top portion defining an underside surface for being releasably positioned on a complementarily configured shoulder defined by the lateral side of the adjacent panel of the first row. In an embodiment, the second side of each panel of the intermediate row comprises a protruding top portion defining an underside surface for being releasably positioned on a complementarily configured shoulder defined by the lateral side of the adjacent panel of the second row.

In an embodiment, the first lateral side of the given panel of the intermediate row comprises a protruding top portion defining an underside surface for being releasably positioned on a complementarily configured shoulder defined by the lateral side of the adjacent panel of the first row. In an embodiment, the second side of the given panel of the intermediate row comprises a protruding top portion defining an underside surface for being releasably positioned on a complementarily configured shoulder defined by the lateral side of the adjacent panel of the second row.

In an embodiment, the rear edge of a given panel of the first row and the front edge of a next rearwardly adjacent panel of the first row are complementarily configured to mate with one another. In an embodiment, the rear edge of the given panel of the first row comprises a protruding portion forming an underside surface, the front edge of the next rearwardly adjacent panel comprises a shoulder for receiving thereon the underside surface of the given panel. In an embodiment, rear edge of the given panel of the first row comprises a shoulder, the front edge of the next rearwardly adjacent panel comprises a protruding portion forming an underside surface for being positioned on the shoulder of the given panel. In an embodiment, the rear edge of a given panel of the second row and the front edge of a next rearwardly adjacent panel of the second row are complementarily configured to mate with one another.

In an embodiment, the rear edge of the given panel of the second row comprises a protruding portion forming an underside surface, the front edge of the next rearwardly adjacent panel comprises a shoulder for receiving thereon the underside surface of the given panel. In an embodiment, the rear edge of the given panel of the second row comprises a shoulder, the front edge of the next rearwardly adjacent panel comprises a protruding portion forming an underside surface for being positioned on the shoulder of the given panel.

In an embodiment, the rear edge of a given panel of the intermediate row and the front edge of a next rearwardly adjacent panel of the intermediate row are complementarily configured to mate with one another. In an embodiment, the rear edge of the given panel of the intermediate row comprises a protruding portion forming an underside surface, the front edge of the next rearwardly adjacent panel comprises a shoulder for receiving thereon the underside surface of the given panel. In an embodiment, the rear edge of the given panel of the intermediate row comprises a shoulder, the front edge of the next rearwardly adjacent panel comprises a protruding portion forming an underside surface for being positioned on the shoulder of the given panel.

In an embodiment, a given panel of the first row comprises top face being mounted to the overhead structure. In an embodiment, a given panel of the second row comprises a top face being mounted of the overhead structure. In an embodiment, a given panel of the intermediate row comprises a top face for being mounted to the overhead structure.

In an embodiment, the top face is mounted to the overhead structure via an attachment. In an embodiment, the top face comprises a groove for removably receiving the attachment therein. In an embodiment, the attachment is fastened to the top face. In an embodiment, the attachment is adhered to the top face. In an embodiment, the attachment comprises a clipping assembly. In an embodiment, the clipping assembly comprises a male portion for being clipped within a female portion. In an embodiment, top face comprises a pair of grooves near each lateral side thereof for receiving respective attachments therein which are mounted to the overhead structure In an embodiment, each attachment comprises a clipping assembly. In an embodiment, each clipping assembly comprises a respective male portion for being clipped within a respective female portion.

In accordance with an aspect of the disclosure, there is provided a kit for providing a suspended ceiling comprising: a plurality of supporting panels for building first and second rows of panels for being connected to overhead structures, each supporting panel comprising front and rear edges and lateral sides; a plurality of removable panels for building an intermediate row of panels interposed between the first and second rows, each removable panel comprising front and rear edges and lateral sides thereof, the first lateral side of each removable panel being configured to be releasably mounted to the complementarily configured lateral side of an adjacent supporting panel of the first row, the second lateral side of each removable panel being configured to be releasably mounted to the complementarily configured lateral side of an adjacent supporting panel of second row, wherein the given removable panel of the intermediate row can be removed by being lifted away from the supporting panels of the first and second rows.

In an embodiment, the first lateral side of each removable panel comprises a protruding top portion defining an underside surface for being releasably positioned on a complementarily configured shoulder defined by the lateral side of the adjacent panel of the first row. In an embodiment, the second side of the removable panel of the intermediate row comprises a protruding top portion defining an underside surface for being releasably positioned on a complementarily configured shoulder defined by the lateral side of the adjacent panel of the second row.

In an embodiment, the rear edge of each supporting panel is complementarily configured to mate with the front edge of another supporting panel. In an embodiment, the rear edge of each supporting panel comprises a protruding portion forming an underside surface and the front edge of each supporting panel comprises a shoulder for receiving thereon the underside surface of another supporting panel. In an embodiment, the rear edge of each supporting panel comprises a shoulder and the front edge of each supporting panel comprises a protruding portion forming an underside surface for being positioned on the shoulder of another supporting panel.

In an embodiment, the rear edge of each removable panel is complementarily configured to mate with the front edge of another removable panel. In an embodiment, the rear edge of each removable panel comprises a protruding portion forming an underside surface and the front edge of each removable panel comprises a shoulder for receiving thereon the underside surface of another removable panel. In an embodiment, the rear edge of each removable panel comprises a shoulder and the front edge of each removable panel comprises a protruding portion forming an underside surface for being positioned on the shoulder of another removable panel.

In an embodiment, each supporting panel comprises a top face being mounted to the overhead structure. In an embodiment, each removable panel comprises a top face being mounted to the overhead structure.

In accordance with an aspect of the disclosure, there is provided a supporting panel for a suspended ceiling, the suspended ceiling comprising first and second rows of supporting panels being connected to overhead structures, and an intermediate row of removable panels interposed between the first and second rows, the supporting panel comprising: a top surface for being connected to an overhead structure; opposite lateral sides for supporting a respective removable panel; and front and rear edges configured to be mated with interfacing edges of like supporting panels.

In accordance with an aspect of the disclosure, there is provided a removable panel for a suspended ceiling, the suspended ceiling comprising a first and second row of supporting panels being connected to overhead structures, and an intermediate row of removable panels interposed between the first and second rows, the removable panel comprising: a top surface; opposite lateral sides for being supported by a respective supporting panel; and front and rear edges configured to be mated with interfacing edges of like removable panels.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated, the disclosure provides a trackless suspended ceiling comprising a plurality of generally rectangular panels. The panels comprise edges which are configured to correspondingly mate when positioning two panels in a side by side manner. The panels are connected to beams via attachment assemblies. The attachment assemblies can be mounted to the panels via grooves formed on the top surface of the panels or by being fastened or otherwise adhered thereto. As such, a suspended ceiling structure is provided with two rows of panels that are connected to the beams and another row of panels interposed therebetween. The edges of the panels of this intermediate row, flanked by the two connected rows, respectively rest on the edges of the panels at each lateral side thereof. The front edge of each panel mates with the rear edge of an upstream panel, whereas the rear edge of each panel mates with the front edge of a downstream panel. This provides a suspended ceiling wherein the space between the ceiling panels is sealed without the use of tracks or runners.

With reference to the Figures, non-limiting illustrative embodiments will now be described.

Figure 1:
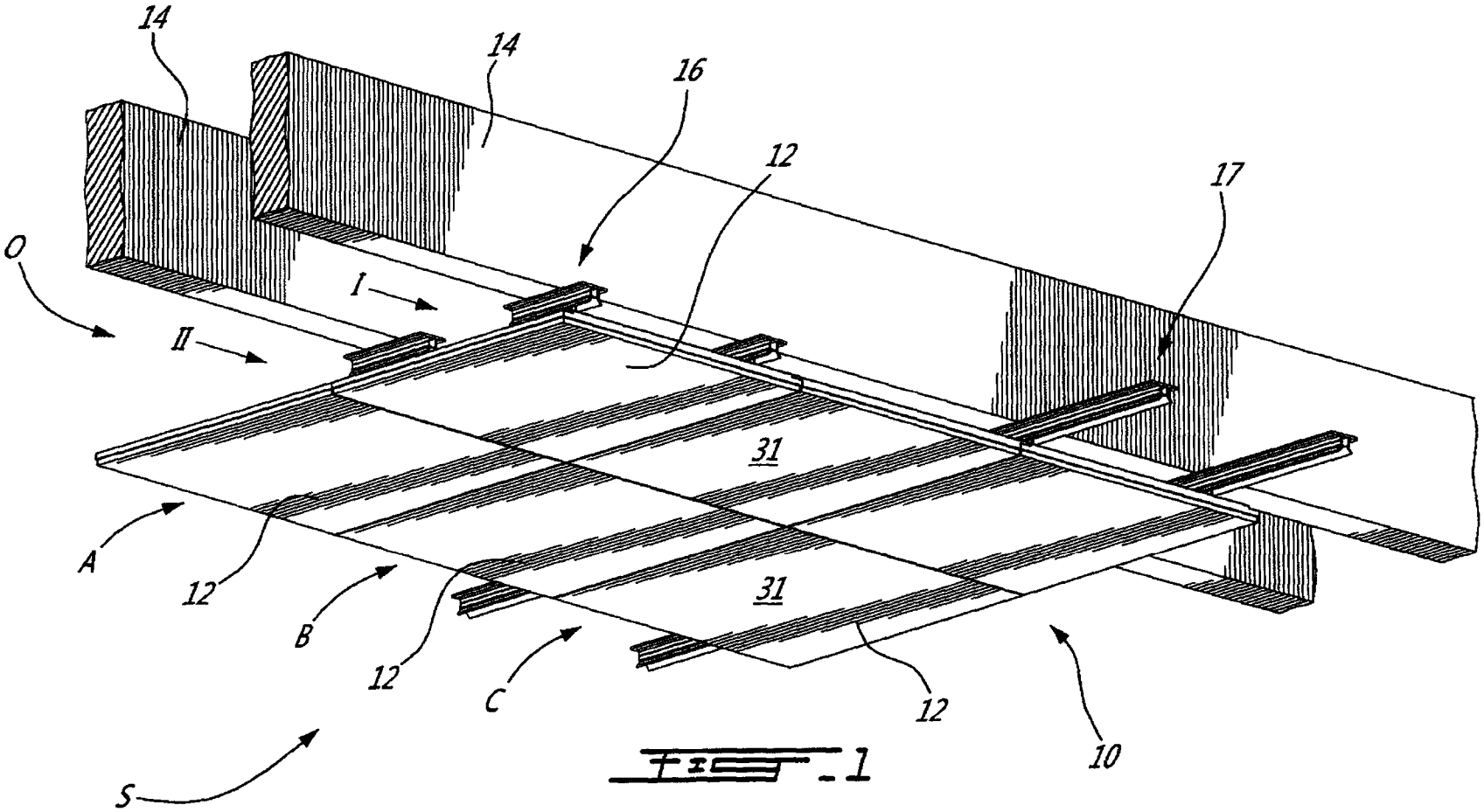
FIG. 1 is a bottom perspective view of a trackless suspended ceiling in accordance with a non-restrictive illustrative embodiment of the present disclosure.

FIG. 1 shows a suspended ceiling structure 10 comprising a plurality of inter-mating ceiling panels 12 connected to overhead structures such as beams 14 via attachments such as clip assemblies 16 and 17.

As shown in the Figures and as will be discussed herein, each panel 12 includes a top face or inner surface 30 (see FIGS. 3-6) and a bottom face or outer surface 31 (see FIGS. 1, 2 and 7). When the ceiling panels 12 are connected to form a ceiling structure the top faces 30 are unexposed and the bottom faces 31 are exposed and form the façade of the ceiling. As better shown in FIGS. 3 to 6, each panel includes a pair of lateral sides 68 and 70 and a front and rear edges 64 and 66 respectively. The structure of the front, rear, and lateral sides will be returned to later. It should be noted that the terms "front" and "rear" are used for indicative purposes only and are thus interchangeable.

Figure 2:
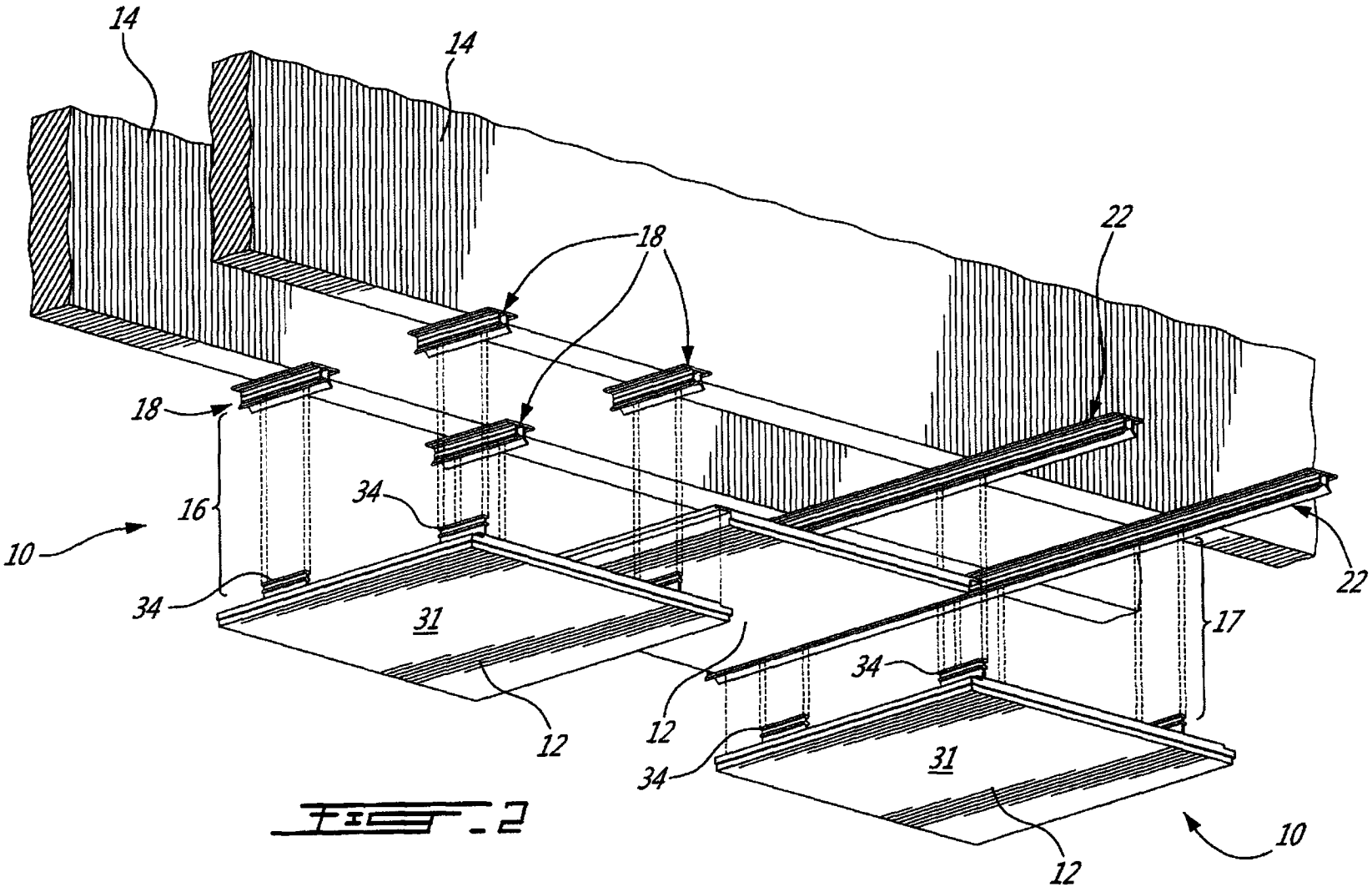
FIG. 2 is a bottom exploded perspective view of the trackless suspended ceiling of FIG. 1.
Figure 3:
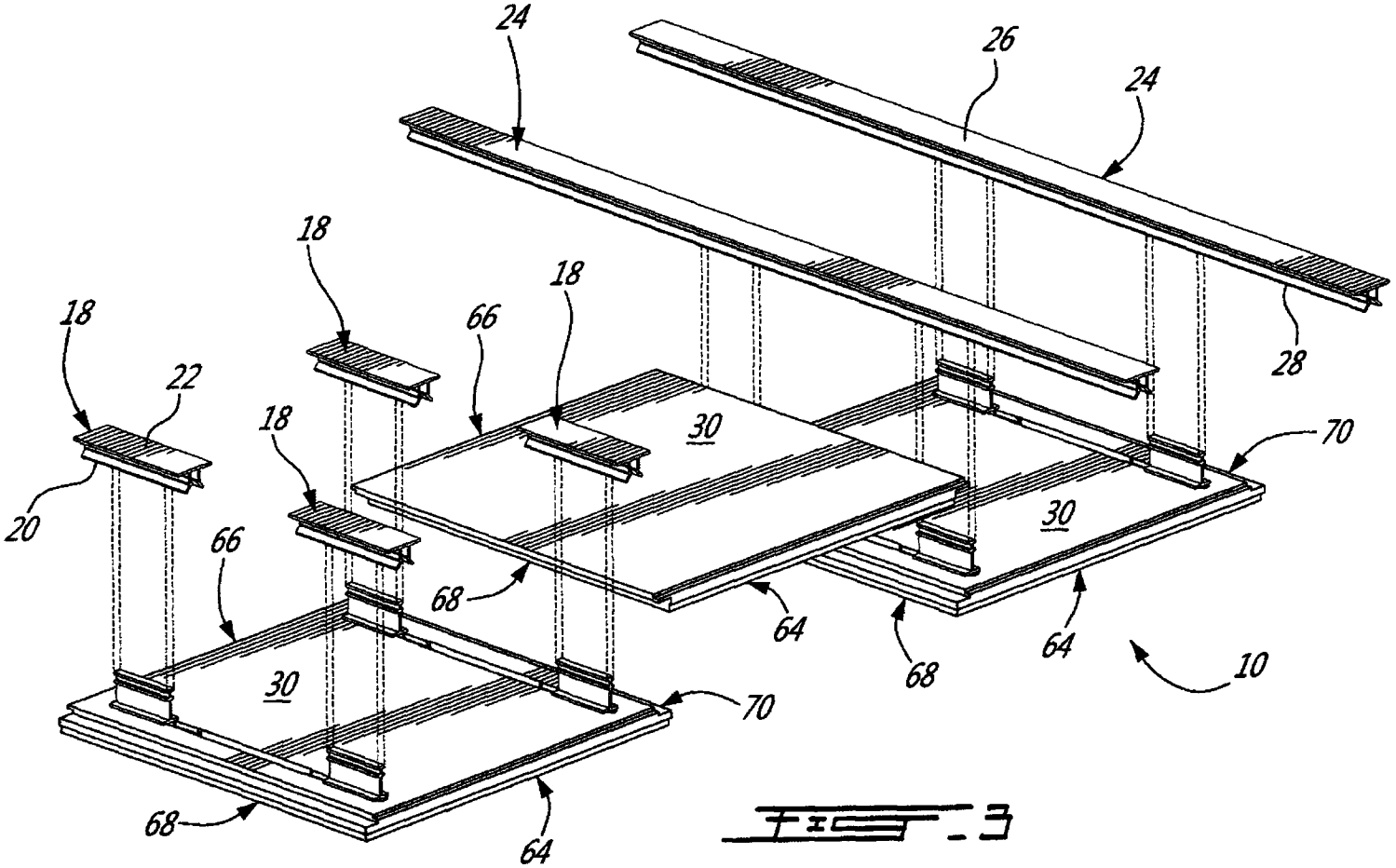
FIG. 3 is top exploded perspective view of the trackless suspended ceiling of FIG. 1.
Figure 7:
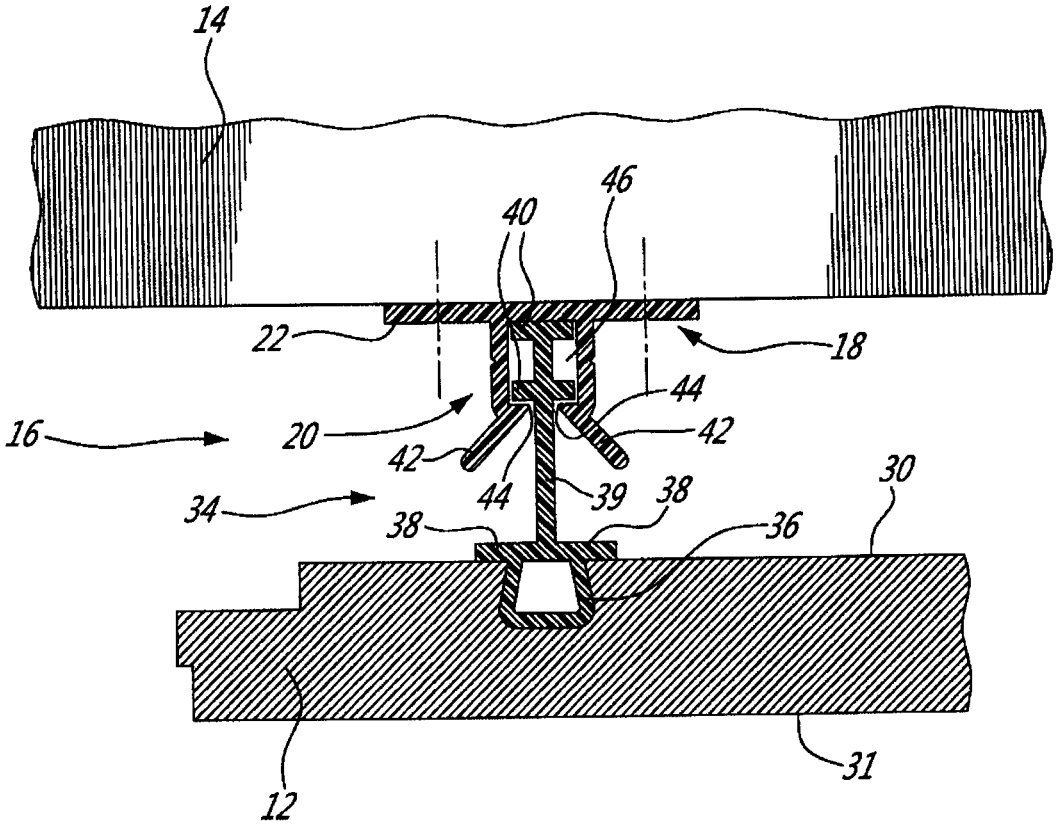
FIG. 7 is a cross-sectional view of FIG. 1 showing the connection between a panel and an overhead structure.

With particular reference to FIGS. 2 and 3 and 7, the clip assembly 16 (see FIG. 7 for assembled version) includes a top clipping member 18 mounted to the beam 14 and a bottom clipping member 34 mounted to the panel 12.

The top clipping member 16 is fastened directly onto the beam 14 and includes a female clipping structure 20 extending from its top plate 22.

There is also shown an assembly 17 (see FIGS. 1, 2 and 3) which includes a top clipping member 24 and the bottom clipping member. The top clipping member has a longitudinal plate 26 which is fastened to the beams 14 as well as a downwardly extending female member 28.

The top clipping member 18 and the top clipping member 24 are similar except for the fact that the member 18 is a short structure that is fastened to a single beam 14, whereas member 24 is an elongated structure that is mounted to a plurality of beams 14. Furthermore, as will be explained herein, the clipping member 18 receives a single male clipping element whereas the clipping member 24 receives a plurality of clipping elements from a plurality of panels.

Figure 4:
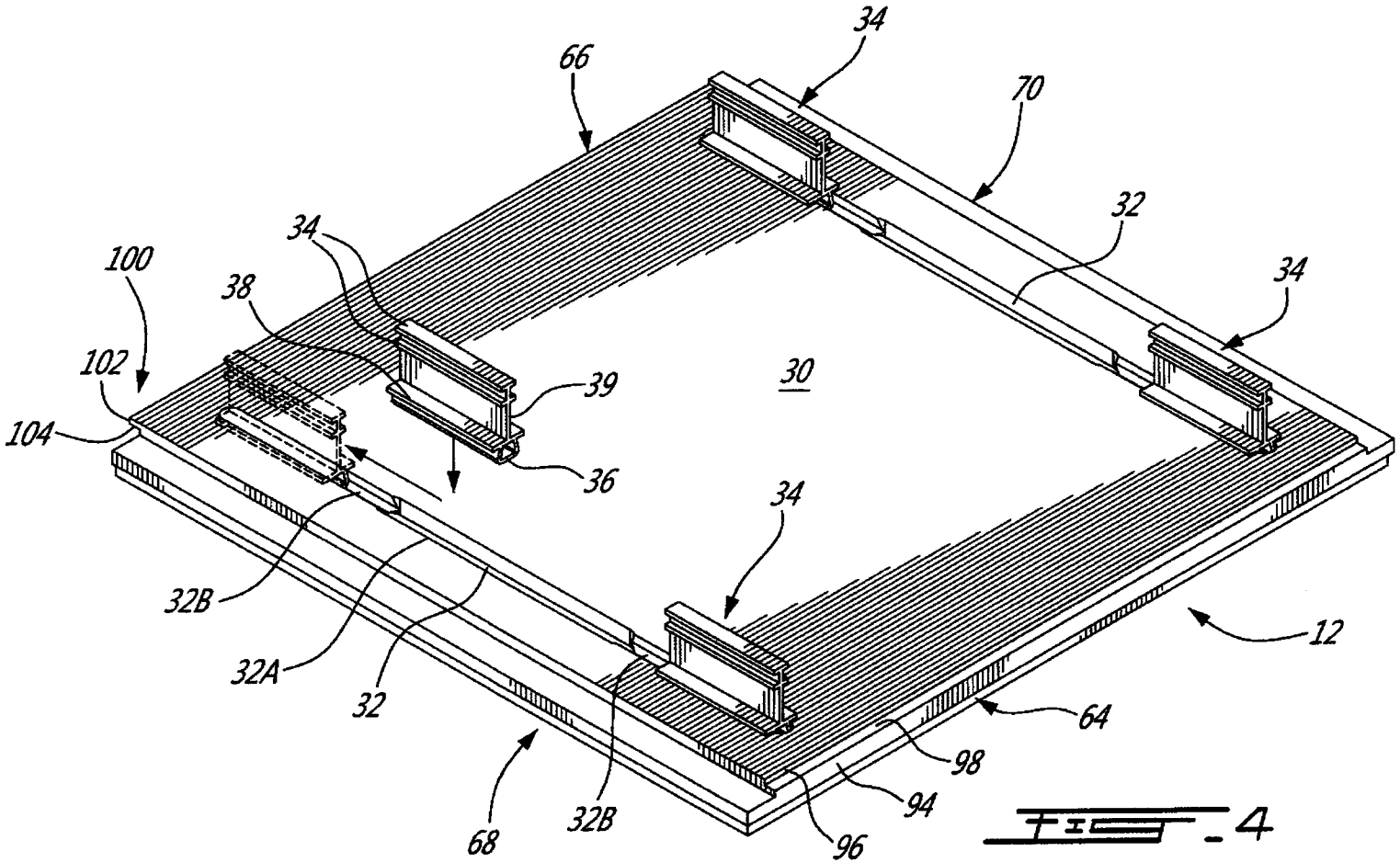
FIG. 4 is top perspective view of a ceiling panel of the trackless suspended ceiling of FIG. 1.

As shown in FIG. 4, each panel 12 includes a top face 30 comprising a pair of grooves 32 near each lateral side 68 and 70 thereof, respectively. Each groove 32 provides for receiving the bottom clipping member 34. As shown in FIGS. 4 and 7, the bottom clipping member 34 includes a lower dovetail 36 configured to be fitted within the groove 32 as well as side flanges 38 which engage the top surface 30 of the panel 12. A vertical stem 39 extends upwardly from the side flanges 38 and includes a set of fins 40 providing a male member which is inserted into the female structure 20 or 28 of the top clipping member 18 or 26, respectively.

Female structures 20 and 28 are similarly constructed with the exception that structure 20 is a short structure and structure 28 is a longer structure.

Turning now to FIG. 7, the female member 20 is shown comprising a pair of angled lower deflectors 42 and defining shoulders 44 being provided where the deflectors connect with the channel 46 defined therebetween. The lower fins 40 rest on shoulders 44.

With reference to FIG. 4, grooves 32 have a dovetail structure so as to retain the dovetail 36 of the lower clipping member 34 for mutual engagement.

Each groove 32 includes a median wider portion 32A between two narrower portions 32B. The dovetail 36 is releasable from the wider portion 32A but is compressed within grooves 32B thereby creating a mutual interference engagement therewith due to the narrower size of grooves 32B and the resiliency of the compressible or deformable dovetail 36.

It should be noted that a variety of top and bottom clipping members or elements can be contemplated within the scope of the present disclosure so as to attach a panel 12 having a pair of grooves for receiving such structures to beams 14 on which similar or like structures are mounted thereto for mutual engagement therewith.

FIG. 7 shows one such example of an attachment between panel 12 to a beam 14 via the clipping assembly 16.

Figure 5:
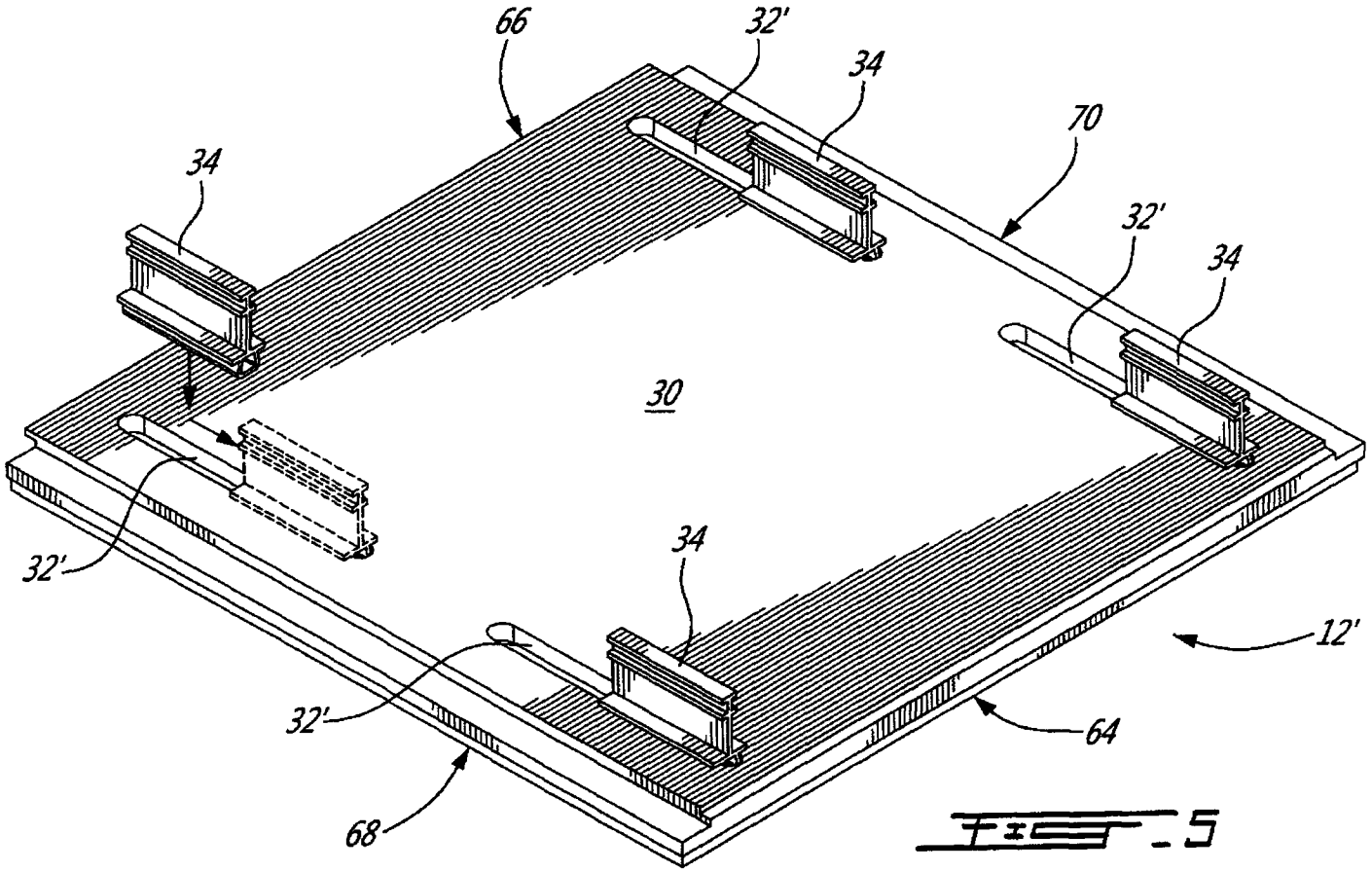
FIG. 5 is top perspective view of a ceiling panel in accordance with another non-restrictive illustrative embodiment of the present disclosure.

Alternatively, FIG. 5 shows a panel 12' comprising a pair of laterally disposed grooves 32' which are shorter and having a constant width, as such each clip member 34 is mounted to its respective groove 32'.

Figure 6:
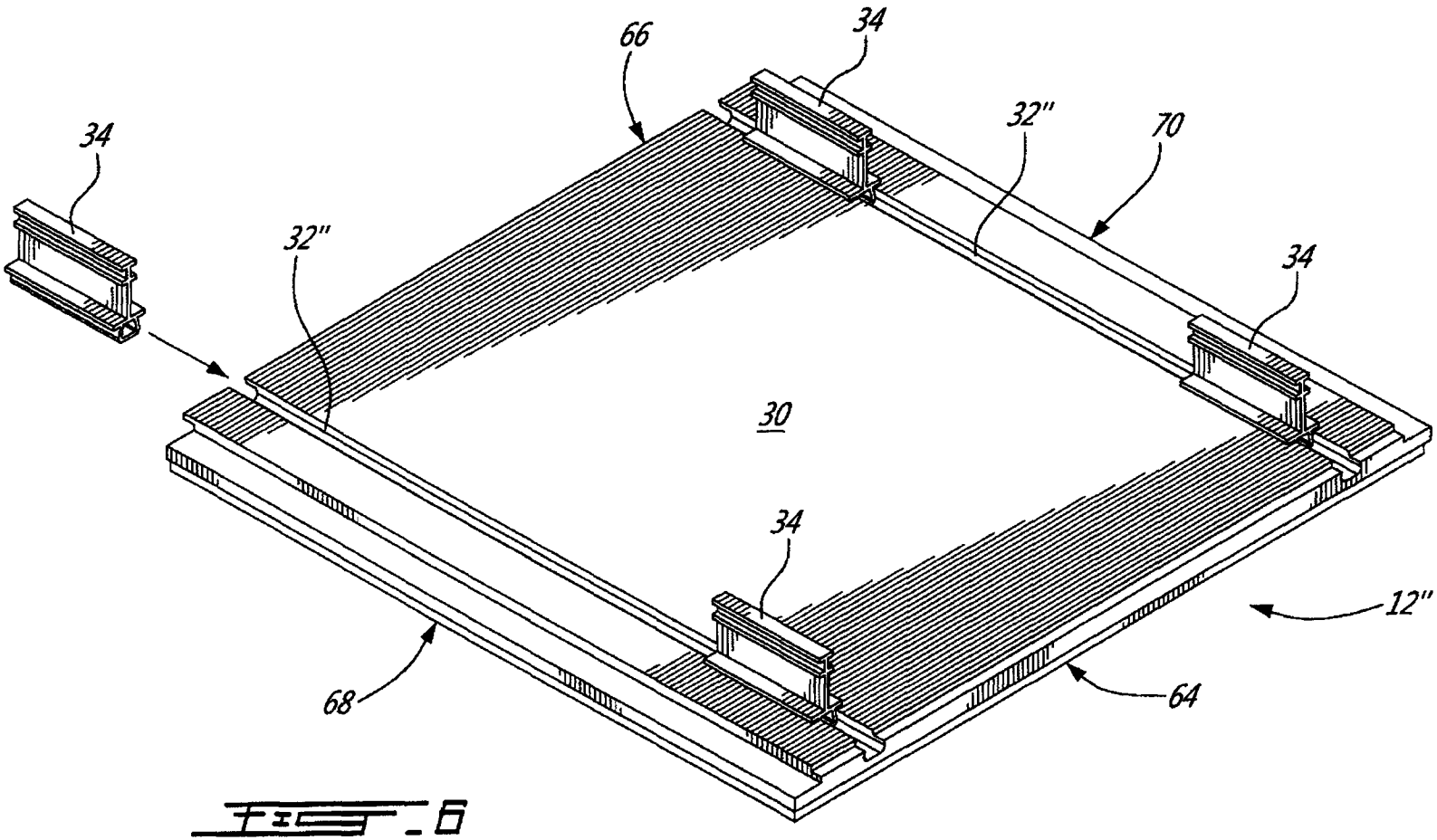
FIG. 6 is top perspective view of a ceiling panel in accordance with another non-restrictive illustrative embodiment of the present disclosure.

Alternatively, FIG. 6 shows a panel 12" comprising a pair of laterally disposed grooves 32" on the top side 30 thereof. The grooves 32" have a constant width and span the length of the top side from the front to the rear edges thereof.

Figure 8:
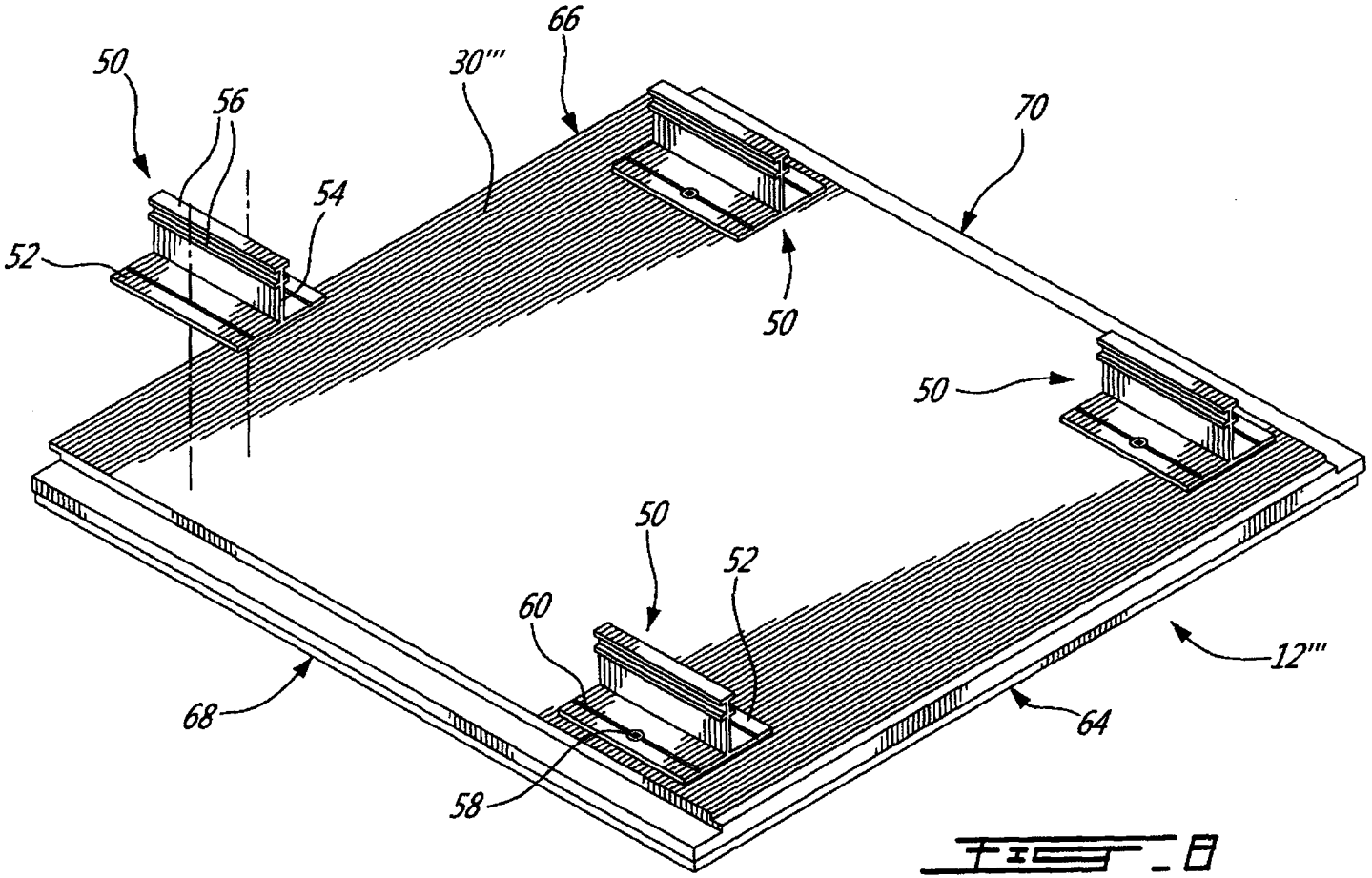
FIG. 8 is a top perspective view of a ceiling panel in accordance with another non-restrictive illustrative embodiment of the present disclosure.
Figure 9:
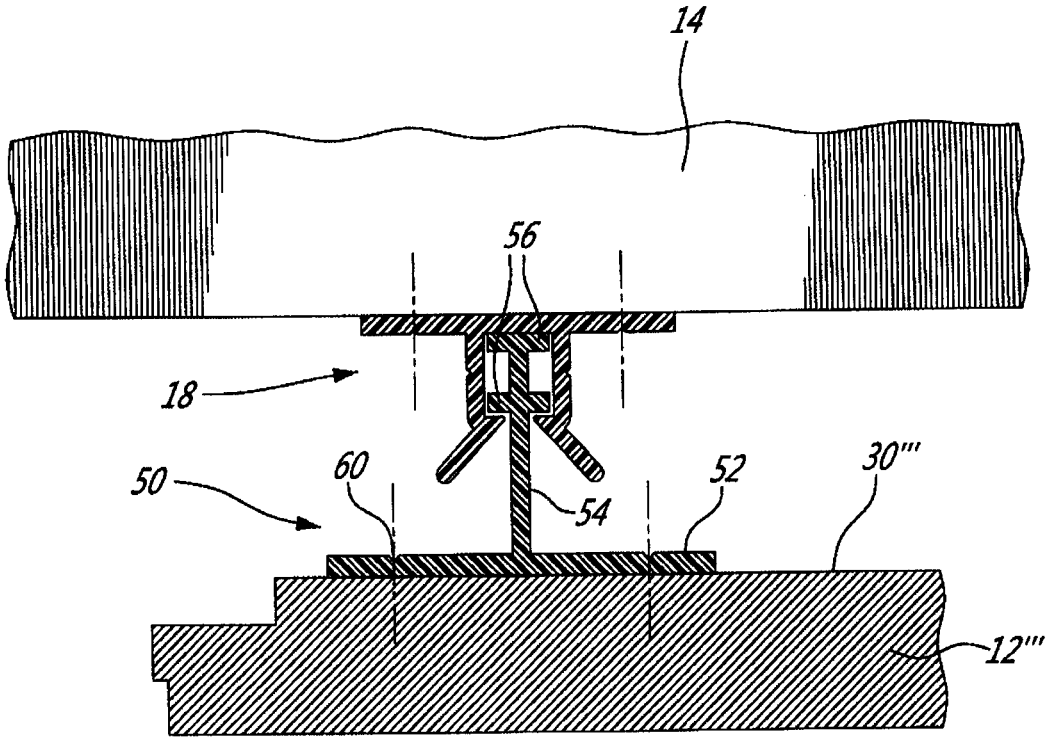
FIG. 9 is a cross section view showing the connection between the panel of FIG. 8 and an overhead structure.

Turning now to FIGS. 8 and 9, there is shown a ceiling panel 12''' comprising a top face 30''' for receiving a plurality of bottom clip members 50 which do not have a dovetail but rather a bottom plate 52 from which the stem 54 extends and carries the fins 56. Panel 12''' does not include any grooves and as such, the bottom clip members 50 are fastened onto the top surface 30''' via fasteners such as screws 58 which are fitted through the longitudinal slits 60 cut into the platform 52 at each side of the stem 54.

Figure 10:
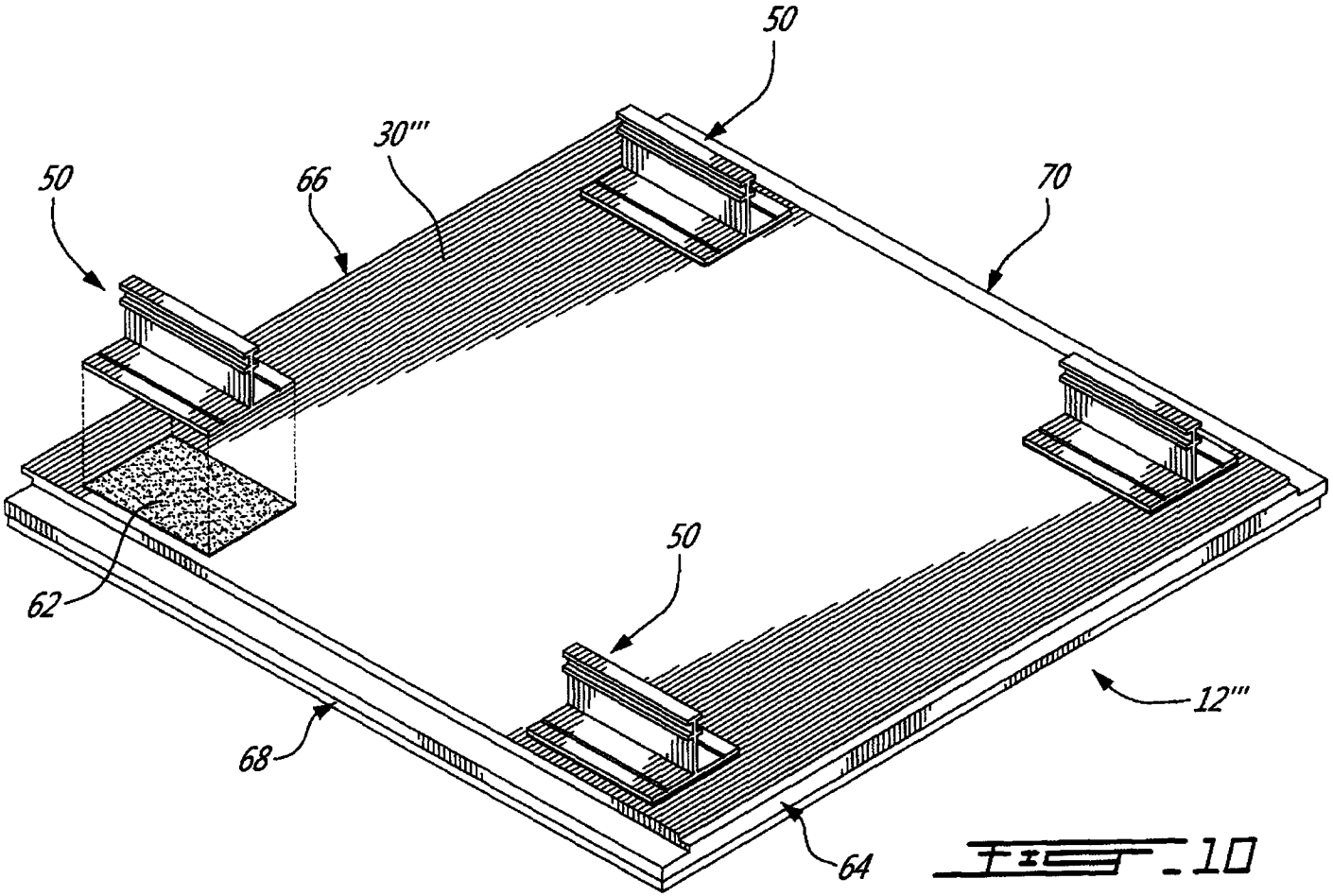
FIG. 10 is a top perspective view of a ceiling panel in accordance with another non-restrictive illustrative embodiment of the present disclosure.
Figure 11:
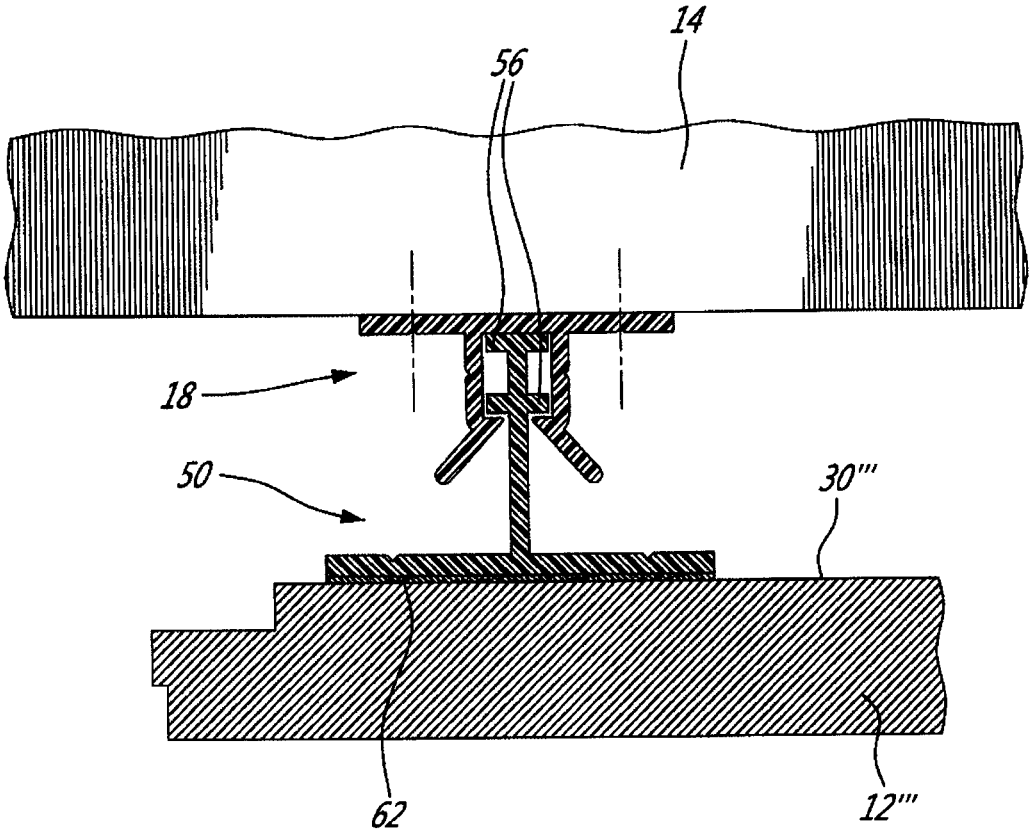
FIG. 11 is a cross section view showing the connection between the panel of FIG. 10 and an overhead structure.

Alternatively in FIGS. 10 and 11, the bottom clip members 50 can be mounted to the face 30''' an adhesive substance 62 and hence forego any use of screws or fasteners.

Of course, other ways of connecting a panel 12', 12" with or 12''' without grooves to a beam via connectors can be contemplated within the scope of the present disclosure.

FIGS. 9 and 11 show that the fins 56 are received within the female portion 20 of the top clipping member 18 as previously described.

The current system described herein does not include lateral runners or tracks and in this way, and with references to FIGS. 3, 4, 5, 6, 8 and 10, the front and rear edges 64 and 66 as well as the lateral sides 68 and 70 of the panels 12, 12', 12" or 12''' (generally referred to as 12 herein when describing edges 64, 66 and sides 68 and 70 for concision purposes only) comprise jagged structures. More specifically, a lateral side 68 of one panel 12 is configured to correspondingly mate with the jagged lateral side 70 of another adjacent panel. Furthermore, the jagged front edge 64 of one panel 12 is configured to correspondingly mate with the rear edge 66 of an adjacent panel 12.

In this way, a plurality of panels 12, as shown in FIG. 1, can be positioned side-to-side with one another so as to provide a ceiling structure 10 with the edges thereof (whether front or rear or lateral) of each side-by-side panel being closely aligned and comprising jagged structures which seal the space there between so as to allow no opening between the bottom area S of the suspended ceiling structure 10 and the overhead area O. More specifically, there are shown three longitudinal rows A, B and C as well as two lateral rows I and II. As shown, clipping assemblies 16 and 17 have been mounted between the panels 12 of rows A and C whereas the panels of rows B are simply inter-connected via their lateral sides 68 and 70 to the corresponding lateral sides 68 and 70 of the panels 12 of rows A and C. Furthermore, the panels 12 of rows I are inter-connected to the panels of row II via their mutually interfering and inter-mating edges 64 and 66. Hence, the panels of rows B can be removed by being lifted and then slightly slanted and removed through the opening created thereby.

Figure 12A:
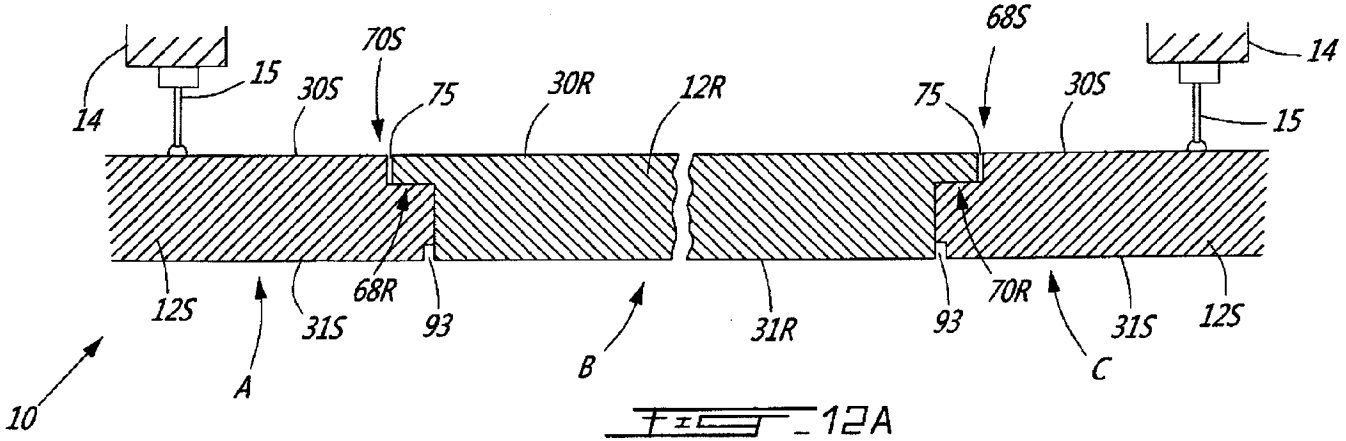
FIG. 12A is a cross section view of a removable panel mounted on supporting panels of a trackless suspended ceiling in accordance with a non-restrictive illustrative embodiment of the present disclosure.
Figure 12B:
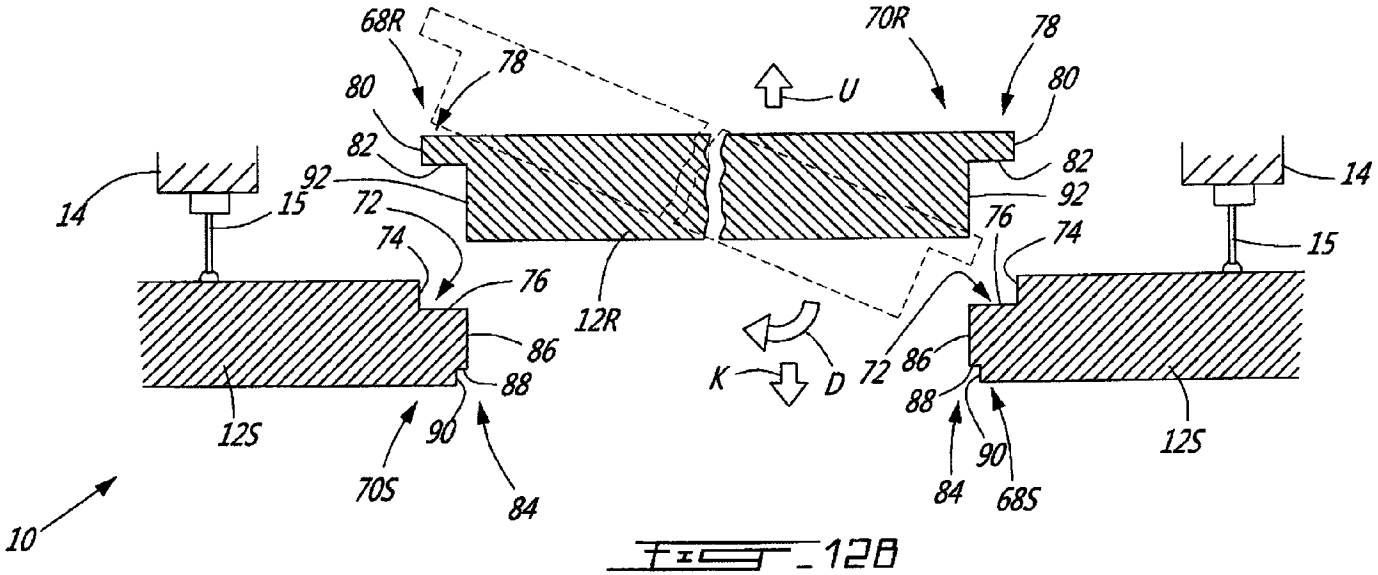
FIG. 12B is a cross section view of a removable panel having been removed from the supporting panels of a trackless suspended ceiling in accordance with a non-restrictive illustrative embodiment of the present disclosure.

Still more specifically and with reference to FIGS. 12A and 12B, the ceiling structure 10 provides supporting panels positioned in rows A and C and generally denoted 12S which are fastened to the beams 14 via attachments generally denoted 15 and supported or removable panels in row B generally denoted 12R.

The panels 12R rest on the lateral sides of the laterally adjacent panels 12S.

Accordingly, the lateral side 68S and 70S of the supporting panels 12S have a recessed top portion 72 defining an upper lateral wall 74 and a large shoulder 76. The lateral side 68R and 70R of the removable panel 12R comprises a protruding top portion 78 mirroring the recessed portion 72 and defining an upper lateral wall 80 and an underside wall 82. Each underside wall 82 of panel 12R rests of the shoulder 76 of the laterally adjacent panel 12S. As such, each wall 80 of the panel 12R interfaces with the upper lateral wall 74 of the laterally adjacent panel 12S. Advantageously, there is a small clearance gap 75 between walls 80 and 74.

Moreover, the lateral sides 68S and 70S of the panels 12S have a recessed bottom portion 84 defining an upper protruding wall 86, a short underside 88 and an inner recessed wall 90. The lateral sides 68R and 70R of the panel 12R include respective lower walls 92, each of which respectively mates with the wall 86 of the laterally adjacent panel 12S and as is slightly spaced apart from the wall 90 by the distance defined by underside 88 to form a minute gap 93 which allows for easier handling of the panel 12R.

Therefore, the panels 12R can be raised upwardly as shown by arrow U and moved diagonally as shown by arrow D, and the brought down as shown by arrow K in order to be removed. The user may then detach the attachments 15 in order to remove panels 12S.

As shown in FIGS. 12A and 12B, the top surfaces 30S and 30R of the panels are generally flush with one another and their bottom surfaces 31S and 31R are also generally flush with one another.

Turning now to FIG. 4, the front edges 64 of the panels 12 includes a main wall 94, a recessed top wall 96 and a shoulder 98 defined therebetween. The rear edges 66 define an upper lip portion 100 defining a protruding wall 102 and an underside surface 104. The underside surface 104 of the rear edge 66 of a panel 12 rests on the shoulder 96 of the front edge of next rearwardly adjacent panel 12 of that row.

As such, the present disclosure provides a suspended ceiling without any tracks between the lateral in a transverse or translational array, providing the look of side-by-side panels within inter-connected edges which seal the spaces between the panels so that light or air is substantially avoided from passing.

The various features described herein can be combined in a variety of ways within the context of the present description so as to provide still other embodiments. It is to be understood that the present description is not limited in its application to the details of construction and parts illustrated in the accompanying drawings and described hereinabove. The description is capable of other embodiments and of being practiced in various ways. It is also to be understood that the phraseology or terminology used herein is for the purpose of description and not limitation. Hence, although the present description has been provided hereinabove by way of non-restrictive illustrative embodiments thereof, it can be modified, without departing from the scope, spirit and nature of the disclosure and appended claims

What is claimed is:

1. A suspended ceiling comprising: a first row of panels being connected to overhead structures, each panel of the first row comprising front and rear edges and lateral sides, and top and bottom sides thereof;

a second row of panels being connected to overhead structures, each panel of the second row comprising front and rear edges and lateral sides thereof, and top and bottom sides thereof;

the rear edge of a given panel of either the first or second rows and the front edge of a next rearwardly adjacent panel a of the same row are complementarily configured to mate with one another, each front edge comprises a main wall, a recessed top wall and a shoulder defined therebetween, each rear edge comprises an upper lip portion defining a protruding wall and an underside surface, the underside surface of the rear edge rests directly and flushly on the shoulder of the front edge of a next rearwardly adjacent panel of that row, the lateral sides of each panel of the first and second rows respectively comprise a recessed top portion defining an upper lateral wall, a shoulder, a lower lateral wall extending from the shoulder and protruding relative to the upper lateral wall and a recessed portion beneath the lower lateral wall, the top sides of each panel of the first and second rows respectively comprise a pair of laterally disposed grooves spanning the length thereof from the front to the rear edges thereof, wherein when assembled the respective lateral grooves of two given adjacent panels of a same given row are contiguous;

a clipping assembly comprising a top single-piece monolithic clipping member for being mounted to the overhead structure and a bottom single-piece monolithic clipping member for being clipped to the top single-piece monolithic clipping member, the bottom single-piece monolithic clipping member being mounted to the contiguous grooves of two given adjacent panels of a given same row; and an intermediate row of panels interposed between the first and second row, each panel of the intermediate row comprising front and rear edges and lateral sides thereof, the first lateral side of a given panel of the intermediate row being configured to be releasably mounted to the complementarily configured lateral side of an adjacent panel of the first row, the second lateral side of the given panel of the intermediate row being configured to be releasably mounted to the complementarily configured lateral side of an adjacent panel of the second row, the first and second lateral sides of each panel of the intermediate row comprises a respective protruding top portion defining an upper lateral wall, an underside wall, and a lower recessed wall, the respective underside wall of the first and second lateral sides being directly, flushly and releasably positioned on the shoulder of the adjacent panel of the first and second rows respectively, the respective upper lateral wall of the first and second lateral sides interfacing and forming a gap with the upper latera lateral wall of the adjacent panel of the first and second rows respectively, the respective lower recessed wall of the first and second lateral sides providing a gap with the recessed portion of the adjacent panel of the first and second rows respectively, the lateral underside walls of a given intermediate panel being longer than the shoulders of each respective laterally adjacent first and second row pan wherein the given panel of the intermediate row can be removed by being lifted away from the panels of the first and second rows.

2. A suspended ceiling according to claim 1, wherein a given panel of the intermediate row comprises a top face for being mounted to the overhead structure.

3. A kit for providing a suspended ceiling comprising:

a plurality of supporting panels for building first and second rows of panels for being connected to overhead structures, each supporting panel comprising front and rear edges and lateral sides, and top and bottom sides thereof;

the rear edge of a given panel of either the first or second rows and the front edge of a next rearwardly adjacent panel of the same row are complementarily configured to mate with one another, each front edge comprises a main wall, a recessed top wall and a shoulder defined therebetween, each rear edge comprises an upper lip portion defining a protruding wall and an underside surface, the underside surface of the rear edge rests directly and flushly on the shoulder of the front edge of a next rearwardly adjacent panel of that row, the lateral sides of each panel of the first and second rows respectively comprise a recessed top portion defining an upper lateral wall, a shoulder, a lower lateral wall extending from the shoulder and protruding relative to the upper lateral wall and a recessed portion beneath the lower lateral wall, the top sides of each panel of the first and second rows respectively comprise a pair of laterally disposed grooves spanning the length thereof from the front to the rear edges thereof, wherein when assembled the respective lateral grooves of two given adjacent panels of a same given row are contiguous;

a plurality of clipping assemblies, each of the clipping assemblies comprising a top single-piece monolithic clipping member for being mounted to the overhead structure and a bottom single-piece monolithic clipping member for being clipped to the top single-piece monolithic clipping member, the bottom single-piece monolithic clipping member being mounted to the contiguous grooves of two given adjacent panels of a given same row;

a plurality of removable panels for building an intermediate row of panels interposed between the first and second rows, each removable panel comprising front and rear edges and lateral sides thereof, the first lateral side of each removable panel being configured to be releasably mounted to the complementarily configured lateral side of an adjacent supporting panel of the first row, the second lateral side of each removable panel being configured to be releasably mounted to the complementarily configured lateral side of an adjacent supporting panel of the second row, the first and second lateral sides of each panel of the intermediate row comprises a respective protruding top portion defining an upper lateral wall, an underside wall, and a lower recessed wall, the respective underside wall of the first and second lateral sides being directly, flushly and releasably positioned on the shoulder of the adjacent panel of the first and second rows respectively, the respective upper lateral wall of the first and second lateral sides interfacing and forming a gap with the upper lateral wall of the adjacent panel of the first and second rows respectively, the respective lower recessed wall of the first and second lateral sides providing a gap with the recessed portion of the adjacent panel of the first and second rows respectively, the lateral underside walls of a given intermediate panel being longer than the shoulders of each respective laterally adjacent first and second row panel, wherein the given removable panel of the intermediate row can be removed by being lifted away from the supporting panels of the first and second rows.

* * * * *